US012606357B2

(12) United States Patent
Tan et al.

(10) Patent No.: US 12,606,357 B2
(45) Date of Patent: Apr. 21, 2026

(54) PAPER BUFFER PACKAGING LAYER AND PACKAGING PAPER

(71) Applicants: Minhong Tan, Yancheng (CN); Jie Wu, Yancheng (CN); JIANGSU RITONG MACHINERY TECHNOLOGY CO., LTD, Yancheng (CN); SUN FOREST ECOTECHNOLOGY (ZHEJIANG) CO., LTD., Ningbo (CN)

(72) Inventors: Minhong Tan, Yancheng (CN); Jie Wu, Yancheng (CN); Xiangmin Ji, Yancheng (CN)

(73) Assignees: Minhong Tan, Yancheng (CN); JIANGSU RITONG MACHINERY TECHNOLOGY CO., LTD, Yancheng (CN); Jie Wu, Yancheng (CN); SUN FOREST ECOTECHNOLOGY (ZHEJIANG) CO., LTD., Ningbo (CN)

( * ) Notice: Subject to any disclaimer, the term of this patent is extended or adjusted under 35 U.S.C. 154(b) by 175 days.

(21) Appl. No.: 18/279,597

(22) PCT Filed: Dec. 8, 2022

(86) PCT No.: PCT/CN2022/137432
§ 371 (c)(1),
(2) Date: Aug. 31, 2023

(87) PCT Pub. No.: WO2023/104132
PCT Pub. Date: Jun. 15, 2023

(65) Prior Publication Data

US 2024/0150106 A1 May 9, 2024

(30) Foreign Application Priority Data

Dec. 10, 2021 (CN) ..... 202123095948.4

(51) Int. Cl.
*B65D 81/03* (2006.01)

(52) U.S. Cl.
CPC ..... *B65D 81/03* (2013.01); *B65D 2581/053* (2013.01)

(58) Field of Classification Search
CPC .. B65D 81/02; B65D 81/03; B65D 2581/053; B31D 5/006
(Continued)

(56) References Cited

U.S. PATENT DOCUMENTS 2,978,006 A 4/1961 Clemens
4,631,221 A * 12/1986 Disselbeck ..... B32B 38/12 428/166
(Continued)

FOREIGN PATENT DOCUMENTS

CN 306806317 S 9/2021
CN 214567598 U 11/2021
(Continued)

OTHER PUBLICATIONS

Extended European Search Report of Counterpart European Patent Application No. 22903552.2 issued on Aug. 26, 2024.
International Search Report of PCT Patent Application No. PCT/CN2022/137432 issued on Mar. 1, 2023.

*Primary Examiner* — Nathan J Newhouse
*Assistant Examiner* — Nina K Attel

(57) ABSTRACT

The present invention provides a paper buffering packaging layer and packaging paper, wherein the paper buffering packaging layer comprises a base layer, and a plurality of buffer packages and a plurality of air chambers formed in the buffer packages, wherein the plurality of buffer packages are formed on the base layer, the air chambers are formed on the inner side of the buffer packages, the buffer package includes a bottom portion and a top portion integrally extending outward from the bottom portion, the bottom
(Continued)

portion of the buffer package integrally extending upward from the base layer to the top portion of the buffer package, wherein the buffer package is further provided with at least one rib groove, and the at least one rib groove is formed on the surface of the buffer package.

2 Claims, 10 Drawing Sheets

(58) Field of Classification Search
USPC ..... 229/87.02; 428/174, 179; 206/521, 206/521.1
See application file for complete search history.

(56) References Cited

U.S. PATENT DOCUMENTS

| | | | | |
|---|---|---|---|---|
| 6,029,962 | A * | 2/2000 | Shorten | B29C 66/1312 267/145 |
| 2011/0318522 | A1 | 12/2011 | Mueller et al. | |
| 2012/0104009 | A1 | 5/2012 | Fascio | |
| 2021/0061535 | A1 | 3/2021 | Moore et al. | |

FOREIGN PATENT DOCUMENTS

| | | | |
|---|---|---|---|
| CN | 216612261 | U | 5/2022 |
| GB | 2446585 | A | 8/2008 |
| JP | H04222298 | A | 8/1992 |
| JP | 2022052117 | A | 4/2022 |
| KR | 102185615 | B1 | 12/2020 |

* cited by examiner

A-A

B-B

PAPER BUFFER PACKAGING LAYER AND PACKAGING PAPER

FIELD OF INVENTION

The present invention is related to the field of packaging technology, and more particularly to paper buffer packaging layer and packaging paper.

DESCRIPTION OF RELATED ARTS

With the rapid development of logistics, packaging paper and bags are increasingly used for the transportation of goods. Most of the packaging paper and packaging bags use bubble packaging paper containing plastic, which has good cushioning and protective properties and can provide better protection for the internal packaging.

Packaging paper is widely used, such as envelopes, packaging bags, etc. Packaging paper needs to provide good sealing performance and cushioning effect. However, the existing bubble wrapping paper containing plastic also has the defects of non-degradability, environmental pollution, difficulty in recycling and the like.

At present, the bubble film packaging materials used in the market are all products made of high-pressure polyethylene as the main raw material, and then added with whitening agent, opening agent and other accessories, which are extruded into bubbles at a high temperature of about 230 degrees. The bubbles are filled with gas, and the stress is buffered by the bubbles to protect the product. Widely used in electronics, instruments, ceramics, handicrafts, household appliances, from the car, kitchen, furniture and paint products, glass products and precision instruments, such as shock-resistant cushioning packaging. It can be made into bubble bags, bubble kraft envelope bags and other products. However, the raw materials used in the production of bubble film are non-recyclable and degradable materials, which also brings tremendous pressure to the environmental protection of our country.

SUMMARY OF THE PRESENT INVENTION

The invention is advantageous in that it provides a paper buffer packaging layer and packaging paper, wherein the paper buffer packaging layer comprises multiple bubble-shaped buffer packages, providing buffering and protective effects.

Another advantage of the invention is to provide a paper buffer packaging layer and packaging paper, wherein the buffer packages of the buffer packaging layer are protruding upwards or concaving downwards, and there is a height difference between the base layer of the buffer packaging layer, so that when the buffer packaging layer is under force, the buffering package can be deformed to provide buffering effect.

Another advantage of the invention is to provide a paper buffer packaging layer and packaging paper, the buffer packages of the buffer packaging layer further include at least two rib grooves, which are formed on the inner side or outer side of the buffer packages, wherein the grooves provide support when the buffer is deformed under force, thereby improving the buffering and protective effect.

Another advantage of the invention is to provide a paper buffer packaging layer and packaging paper, wherein the rib grooves of the buffer packaging layer include horizontal grooves and vertical grooves, wherein the horizontal and vertical grooves contribute to improving the buffering effect.

The technical problem to be solved by the present invention is to provide a deformable and degradable buffering monomer structure with buffering effects.

Correspondingly, the present invention also provides a packaging paper with the deformable cushioning monomer structure and a packaging paper bag with the deformable cushioning monomer structure.

According to the present invention, the foregoing and other objects and advantages are attained by a paper packaging buffer layer, which comprises:

a base layer; and a plurality of buffer packages and a plurality of air chambers formed in the buffer packages, wherein the plurality of buffer packages are formed on the base layer, the air chambers are formed on the inner side of the buffer packages, the buffer package includes a bottom portion and a top portion integrally extending outward from the bottom portion, the bottom portion of the buffer package integrally extending upward from the base layer to the top portion of the buffer package, wherein the buffer package is further provided with at least one rib groove, and the at least one rib groove is formed on the surface of the buffer package.

According to one embodiment of the present invention, the buffer package has a hemispherical bubble structure.

According to one embodiment of the present invention, the rib groove is formed on the outer surface of the cushion pack and recessed inward from the outer surface of the cushion pack.

According to one embodiment of the present invention, the rib groove further comprises a weft rib groove, wherein the weft rib groove is formed in the buffer package in an annular structure, and the plane of the weft rib groove is parallel to the base layer.

According to one embodiment of the present invention, the rib groove further comprises a longitudinal rib groove formed in the buffer package in a semi-annular structure, wherein a plane of the longitudinal rib groove is substantially perpendicular to the substrate.

According to one embodiment of the present invention, the spacing distance between each longitudinal rib groove is equal.

According to one embodiment of the present invention, the longitudinal rib groove extends from the bottom of the buffer package to the top of the buffer package.

According to one embodiment of the present invention, the weft rib groove further comprises at least two weft rib walls, wherein the at least two weft rib walls integrally extend from the buffer package and form a groove body of the weft rib groove between the at least two warp rib walls.

According to one embodiment of the present invention, the longitudinal rib groove further includes at least two longitudinal rib walls, and the rib groove body structure of the longitudinal rib groove is formed between the at least two longitudinal rib walls, the at least two longitudinal rib walls of the longitudinal rib groove are longitudinally disposed along the buffer package.

According to one embodiment of the present invention, the weft rib groove and longitudinal rib groove of the buffer are in a linear, curved, or wavy structure.

According to one embodiment of the present invention, the outer side diameter of the bottom of the buffer package is H1, and the spacing between the bottoms of adjacent buffer packages is H2, wherein H1 and H2 satisfy the following condition: $0 \leq H1 \leq H2$.

According to one embodiment of the present invention, the buffer package further includes a first buffer package and a second buffer package, wherein the bottom diameter of the first buffer package is larger than that of the second buffer package.

According to one embodiment of the present invention, the outer diameter of the bottom of the buffer package on the outer side is H1, and the spacing between the bottoms of adjacent buffer packages is H2, where H1 and H2 satisfy the following condition: H1≤H2.

According to one embodiment of the present invention, the base layer has a front and a back, and the buffer is formed on the front or back of the base layer.

According to one embodiment of the present invention, the base layer has a front and a back, and the buffer package comprises a front buffer package and a back buffer package, wherein the front buffer package is formed on the front of the base layer, and the back buffer package is formed on the back of the base layer.

According to one embodiment of the present invention, the front buffer package integrally extends from the back buffer package.

According to another aspect of the present invention, the present invention further provides a packaging paper comprising:

an inner layer and an outer layer; and at least one paper packaging buffer layer as in any above, wherein the at least one packaging buffer layer is set between the inner layer and the outer layer.

According to one embodiment of the present invention, the packaging buffer layer further comprises a first buffer layer and a second buffer layer, wherein the first buffer layer and the second buffer layer are oppositely arranged, and the buffer packet of the first buffer layer is set within the interval space of the second buffer layer, and the buffer packet of the second buffer layer is set within the interval space of the first buffer layer.

According to one embodiment of the present invention, the packaging buffer layer further comprises an inner buffer layer and an outer buffer layer, wherein the size of the buffer package of the inner buffer layer is smaller than the size of the buffer package of the outer buffer layer, and the buffer package of the inner buffer layer is sleeved inside the outer buffer layer.

According to one embodiment of the present invention, the inner buffer layer and the inner layer form an inner air chamber, the inner buffer layer and the outer buffer layer form an outer air chamber, and the inner and outer air chambers of the packaging buffer layer form a dual air chamber buffer structure.

To solve the above technical problems, the deformable buffer monomer structure provided by the present invention includes: a deformation part and a connecting part;

The deformation part is formed into a spherical crown, and multiple strengthening parts are formed on the outer curved surface of the spherical crown, which can undergo deformation under force;

The connecting part is formed around the deformation part, and the self deformation part of the connecting part extends outward;

Among them, the deformation part and the connecting part are made of biodegradable and environmentally friendly materials.

Optionally, further improve the deformable buffer monomer structure to form at least two reinforcing parts.

Optionally, further improve the deformable buffer monomer structure, with four reinforcing parts.

Optionally, further improve the deformable buffer monomer structure, with nine reinforcing parts.

Optionally, further improving the deformable buffer monomer structure, including:

A bonding part is formed on the bottom surface of the connecting part, which is used to bond and fix the deformable buffer monomer structure to the external structure. The bonding part can be a non-drying adhesive coating.

Optionally, further improve the deformable buffer monomer structure, with the adhesive part covering all the bottom surfaces of the connecting parts.

In order to solve the above technical problems, the present invention provides a wrapping paper having any one of the above deformable buffer monomer structures, which is formed by connecting a plurality of connecting parts of the deformable buffer monomer structures to each other.

The adhesive part of that deformable buff monomer structure for the PAC paper can cover the bottom surface of the connecting part; The adhesive part can also be set as an adhesive point, one adhesive point can be set for each deformable buffer single structure, and the adhesive point can also be shared by a plurality of deformable buffer single structures, and in principle, the wrapping paper can be adhered and fixed on the external structure to be protected.

Optionally, the deformable buffer monomer structures are further improved, and the deformable buffer monomer structures are different in size, spacing and/or color.

Deformable buffer monomer structures with different sizes can provide different buffer strengths, and large-size deformable buffer monomer structures can be arranged at positions needing larger buffer according to actual requirements, and small-size deformable buffer monomer structures can be arranged at other positions.

In addition, the deformable buffer monomer structures with different sizes can be used for forming different patterns, for example, when the deformable buffer monomer structures with different sizes of the wrapping paper are bonded and protected outside the product, LOGO patterns and the like are formed for displaying selected contents.

In order to solve the above technical problems, the present invention provides a packaging paper bag with any one of the above deformable buffer monomer structures, wherein the bag body is any one of the existing packaging paper bags, and at least one deformable buffer monomer structure is adhered to the inner wall of the bag.

Further objects and advantages of the present invention will become more fully apparent from an understanding of the following description and accompanying drawings.

These and other objects, features, and advantages of the present invention will become more fully apparent from the following detailed description and accompanying drawings.

The invention can at least realize the following technical effects:

1. It is made of degradable materials, which can avoid environmental pollution and meet environmental protection requirements.

2, that invention can be quickly fix on the protected product through the adhesive part, and the applicability is improved.

And 3, a deformable buffer monomer structure is used for buffering, so that the difficulty of the production process is reduced and the production efficiency is improved compared with a bubble structure in the prior art.

And 4, the size, the number and the spacing of the deformable buffer monomer structures can be selected according to actual requirements to adjust the limit pressure which can be borne by the bubble paper, different structures are formed according to different pressure requirements, and the applicability of the bubble paper is further improved.

5. The packaging paper can form different patterns by setting the size, quantity, spacing and color of the deformable buffer monomer structure, so as to form advertisements, LOGO and other propaganda contents and improve the economic benefits of the packaging paper.

BRIEF DESCRIPTION OF THE DRAWINGS

The accompany drawings are intend to complement that description in the specification by illustrating the general nature of methods, structures, and/or material used in accordance with specific exemplary embodiments of the invention. The accompany drawings of that present invention, however, are not to scale and, as such, may not accurately reflect the precise structural or performance characteristic of any given embodiment and should not be construed to define or limit the scope of values or properties encompass by exemplary embodiments in accordance with the present invention. The present invention will be described in further detail below with reference to the accompanying drawings and specific embodiments.

DETAILED DESCRIPTION OF THE PREFERRED EMBODIMENT

Figure 1:
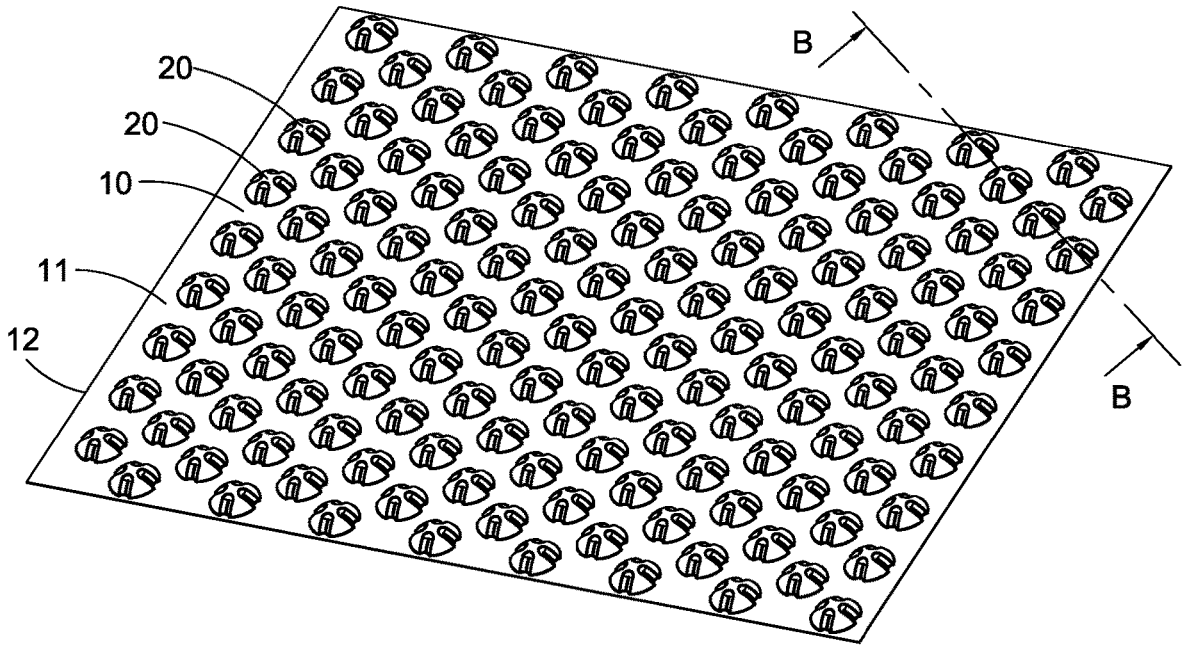
FIG. 1 shows a schematic diagram of a paper buffer packaging layer according to the first preferred embodiment of the present invention.
Figure 2A:
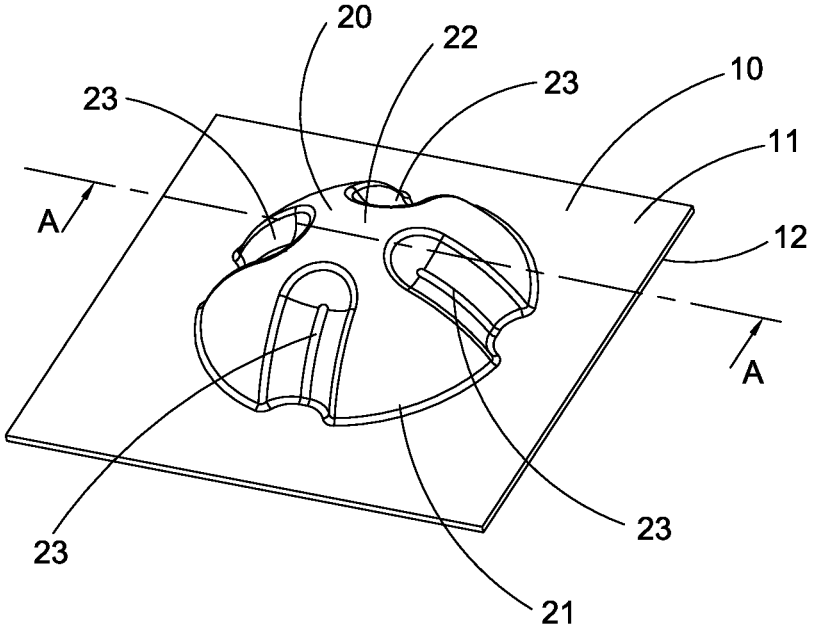
FIGS. 2A and 2B are schematic diagrams of the structure of the buffer package of the buffer layer of the present invention's first preferred embodiment.
Figure 2B:
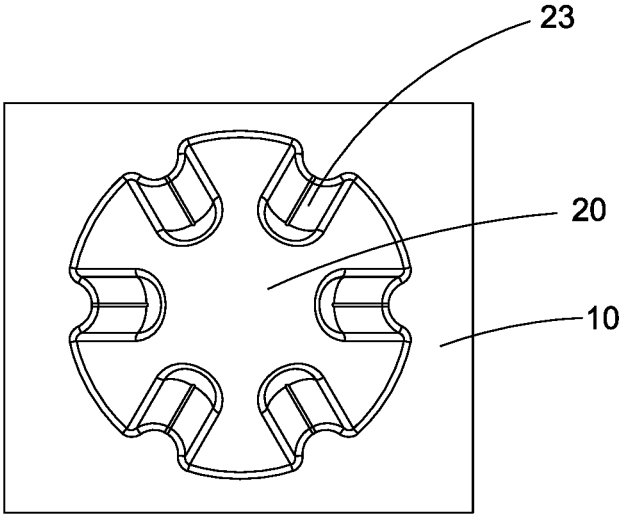

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

The skilled technicians in the art should understand that, in the disclosure of this present invention the technical terms, "longitudinal", "lateral", "upper", "lower", "front", "rear", "left", "right", the orientation or positional relationship indicated by "vertical", "horizontal", "top", "bottom", "inner", "outer", etc. are based on the orientation or positional relationship shown in the drawings, this is only for the convenience and simplifying the description for the present invention, it does not indicate or imply that the pointed device or element must have a specific orientation, be constructed and operated in a specific orientation, so the above terms should not be understood as a limitation of the present invention.

It can be explained that the term "a" should understood as "at least one" or "one or more", that is, in one embodiment, the number of an element can be one, and in another embodiment, the number of the element can be multiple, and the term "one" cannot be understood as a limitation on the number.

Referring to FIGS. 1 to 4E as shown in the accompanying drawings of this application, a paper buffer packaging layer in the first preferred embodiment of this application is described in the following. In this application, for ease of description, the paper buffer packaging layer mentioned below will be referred to as the buffer packaging layer.

The buffer packaging layer includes a base layer 10 and A plurality of buffer packages 20 formed on the base layer 10. The buffer packages 20 are integrated with the base layer 10 and formed on one side of the base layer 10. In this preferred embodiment of the application, the base layer 10 has a front surface 11 and a back surface 12, where the buffer packages 20 protrude from the front surface 11 and/or the back surface 12 of the base layer 10. It can be understood that due to the buffer packages 20 protruding from the base layer 10, when the buffer packaging layer is subjected to lateral force, the buffer packages 20 will deform under force to provide cushioning effect.

It is worth mentioning that in this preferred embodiment of the present application, the buffer packaging layer is made of paper material. The buffer packages 20 of the buffer packaging layer is integrally formed on one side of the base layer 10's buffer structure through stamping, extrusion, or rolling. Preferably, in this preferred embodiment of the present application, the buffer packages 20 of the buffer packaging layer has a hemispherical bubble-like structure, and provides a cushioning effect supported by the base layer 10.

In this preferred embodiment of the present application, the buffer layer is further provided with a plurality of air chambers 201, wherein the air chambers 201 are formed on the inner side of the buffer package 20, and are filled with gas or other cushioning materials, such as sponge, or filled with gas. The air chambers 201 of the buffer packaging layer can support the buffer package 20 of the buffer packaging layer, which is advantageous for improving the cushioning and supporting effect of the buffer packaging layer.

As shown in FIGS. 1 to 4E, the base layer 10 of the buffer packaging layer is a paper-based structure, where the base layer 10 can be made of a paperboard with certain hardness or a paper with certain flexibility. The buffer packages 20 protrudes from the upper and/or lower side of the base layer 10, with its bottom end connected to the base layer 10, and its top end protruding from the front 11 and/or back 12 of the base layer 10.

The buffer package 20 of the buffer packaging layer includes a bottom 21 and a top 22 that extends outward from the bottom 21, wherein the bottom 21 of the buffer package 20 is connected to the base 10 and provides support for the buffer package 20 through the base 10; the top 22 of the buffer package 20 is located on the outer side of the bottom 21, and when the buffer packaging layer is subjected to force, the top 22 of the buffer package 20 undergoes deformation under the action of force to provide support and buffering. It can be understood that the buffer package 20 protrudes from the base layer 10. Therefore, when the buffer packaging layer receives external force, the top 22 of the buffer packages 20 will be first affected by the force and deform.

Preferably, in this preferred embodiment of the present application, the buffer packages 20 is hemispherical. In another optional embodiment of the present application, the buffer packages 20 has a cylindrical structure or a heart-shaped protrusion. Therefore, the shape of the buffer packages 20 in the present application is only exemplary, not limiting. The bottom 21 of the buffer packages 20 extends integrally upwards or downwards from the base layer 10 to the top 22 of the buffer packages 20. Preferably, in a better embodiment of the present application, the bottom 21 of the buffer packages 20 extends vertically upwards or downwards from the base layer 10. When the top 22 of the buffer packages 20 is subjected to force, the bottom 21 of the buffer packages 20 transmits the force along the direction perpendicular to the base layer 10, which is beneficial to improve the supporting effect of the buffer packages 20.

Figure 3A:
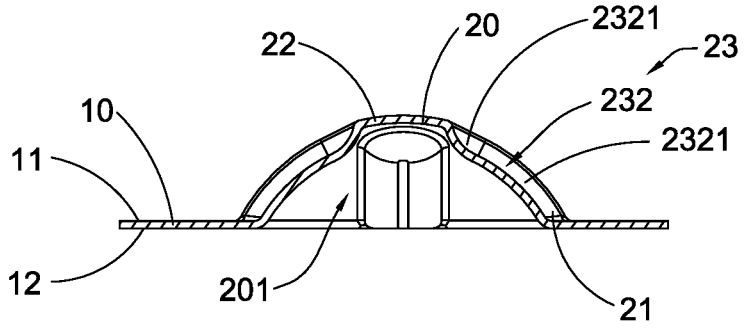
FIGS. 3A and 3B are cross-sectional diagrams of the buffer package of the buffer layer of the packaging of the first preferred embodiment of the present invention.
Figure 3B:
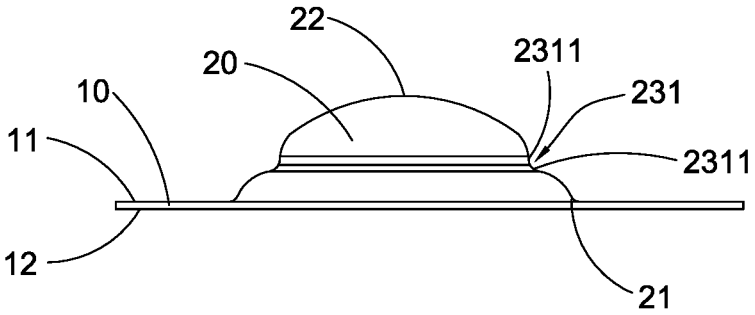

As shown in FIGS. 3A and 3B, the buffer package layer further includes a buffer packages 20, which is provided with at least one rib groove 23, wherein the at least one rib groove 23 is formed on the surface of the buffer packages 20 and increases the strength of the buffer packages 20 through the rib groove 23, so that the buffer packages 20 has a supporting effect when subjected to force, thereby improving the buffer effect of the buffer package layer.

As shown in FIGS. 3A and 3B, the buffer packages 20 of the buffer package layer further includes at least one rib groove 23, wherein the at least one rib groove 23 is formed on the surface of the buffer packages 20 and increases the strength of the buffer packages through the rib groove 23, so that the buffer packages 20 has a supporting effect when subjected to force, thereby improving the buffer effect of the buffer package layer.

The rib groove 23 is formed on the outer surface of the buffer packages 20 and is recessed inward from the outer surface of the buffer packages 20. In other words, the rib groove 23 is a rib groove structure formed on the buffer packages 20. The rib groove 23 is a rib groove structure formed on the outer surface of the buffer packages 20.

As shown in FIGS. 3A and 3B, in the preferred embodiment of the present application, the rib groove 23 further includes a weft rib groove 231, wherein the weft rib groove 231 has a ring-shaped structure formed in the buffer packages 20. The plane where the weft rib groove 231 is located is roughly parallel to the base layer 10. When the top 22 of the buffer packages 20 is under stress, the weft rib groove 231 of the rib groove 23 will deform due to the force to provide a buffering effect. The rib groove 23 further includes a longitudinal rib groove 232, wherein the longitudinal rib groove 232 has a semi-ring shaped structure formed in the buffer packages 20. The plane where the longitudinal rib groove 232 is located is roughly perpendicular to the base layer 10. When the top 22 of the buffer packages 20 is under stress, the longitudinal rib groove 232 of the rib groove 23 provides support.

Understandably, in this preferred embodiment of the present application, the number of rib grooves 23 can be odd or even. Preferably, in this preferred embodiment of the present application, the number of longitudinal rib grooves 232 in the rib grooves 23 can be 3, 5, 7, etc., and the spacing between each of the longitudinal rib grooves 232 is equal. When the number of longitudinal rib grooves 232 in the rib grooves 23 is 2, 4, or 6, the longitudinal rib grooves 232 are formed symmetrically on the outer surface of the buffer packages 20.

Specifically, the longitudinal rib groove 232 extends from the bottom 21 of the buffer packages 20 to the top 22 of the buffer packages 20. Alternatively, in another optional embodiment of the present application, the length of the longitudinal rib groove 232 is one-third or two-thirds of the length from the bottom 21 to the top 22 of the buffer packages 20.

The weft rib groove 231 further comprises at least two weft rib walls 2311, wherein the at least two weft rib walls 2311 are integrally extended from the buffer packages 20, and form the rib groove body of the weft rib groove 231 between the at least two weft rib walls 2311. It is worth mentioning that in this preferred embodiment of the present application, the weft rib walls 2311 of the weft rib groove 231 overlap with each other, and when the buffer packages 20 is subjected to force, the adjacent two weft rib walls 2311 of the weft rib groove 231 separate under the action of force, thereby providing a buffering effect of force.

The weft rib groove 231 further comprises at least two weft rib walls 2311, wherein the at least two weft rib walls 2311 are integrally extended from the buffer packages 20, and a rib groove body of the weft rib groove 231 is formed between the at least two weft rib walls 2311. It is worth mentioning that in this preferred embodiment of the present application, the weft rib walls 2311 of the weft rib groove 231 overlap with each other, and when the buffer packages 20 is subjected to force, the adjacent two weft rib walls 2311 of the weft rib groove 231 separate under the action of force, thereby providing a buffering effect of force.

The longitudinal rib groove 232 further comprises at least two longitudinal rib walls 2321, and a rib groove structure of the longitudinal rib groove 232 is formed between the at least two longitudinal rib walls 2321. The at least two longitudinal rib walls 2321 of the longitudinal rib groove 232 are longitudinally located along the buffer packages 20, and when the top of the buffer packages 20 is under stress, the at least two longitudinal rib walls 2321 of the longitudinal rib groove 232 provide supportive force to enhance the supporting function of the buffer.

It can be understood that in the preferred embodiment of the present application, the at least two weft rib walls 2311 of the weft rib groove 231 and the at least two longitudinal rib walls 2321 of the longitudinal rib groove 232 extend inward from the outer surface of the buffer packages 20, forming an outward-in structure that helps to improve the structural characteristics of the buffer.

It should be noted that in this preferred embodiment of the present application, the weft rib groove 231 and the longitudinal rib groove 232 of the buffer packages 20 are in a linear, curved or wave-like structure, and the shape of the weft rib groove 231 and the longitudinal rib groove 232 are only exemplary, rather than limiting.

Figure 4A:
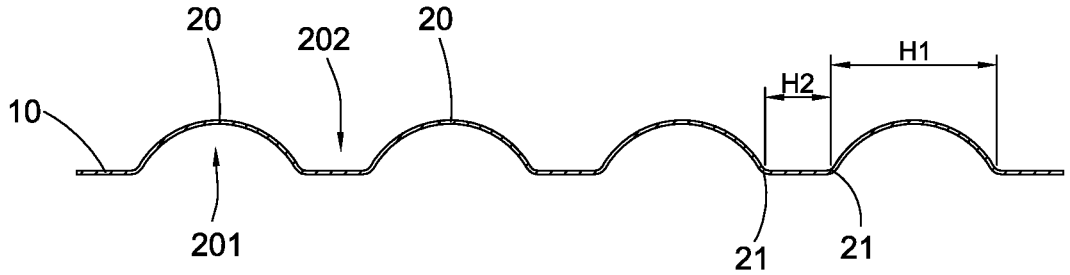
FIGS. 4A to 4E are sectional views of the buffer packaging layer according to the first preferred embodiment of the present invention.

As shown in FIGS. 4A to 4E, the structure of the buffer packaging layer is further explained in another aspect of this application, wherein the buffer package 20 of the buffer packaging layer is uniformly formed on the base layer 10. As shown in FIG. 4A, in this preferred embodiment of the present application, the sizes of the respective buffer packages of the buffer packaging layer are uniform, and the buffer packaging layer further has a gap space 202, which is formed on one side of the base layer 10 and located on the outer side of each of the buffer packages 20. It will be appreciated that the gap space 202 of the buffer packaging layer is formed on the same side of the buffer package 20 and can be filled with buffer material, facilitating a better buffering effect. It will be appreciated that when the buffer packaging layer is sealed, gas can be filled in the gap space 202 and the air chamber 201 of the buffer package 20 to form mutually spaced gas storage chambers. When the buffer packaging layer is subjected to force, the gap space 202 and the air chamber 201 inside the buffer package 20 are subjected to compressive force, providing a reverse force that is beneficial to provide gas buffering effect.

As shown in FIG. 4A, the outer diameter of the bottom 21 of the buffer packages on the outer side is H1, and the distance between the bottoms 21 of adjacent buffers 20 is H2, where H1 and H2 satisfy the following condition: $0 \geq H1 \geq H2$. This means that A plurality of buffers 20 are arranged on one side of the base layer 10 at intervals to improve the buffering effect of the buffer layer, and to provide good support and pressure-bearing effect for the buffers 20 that are spaced apart.

Figure 4B:
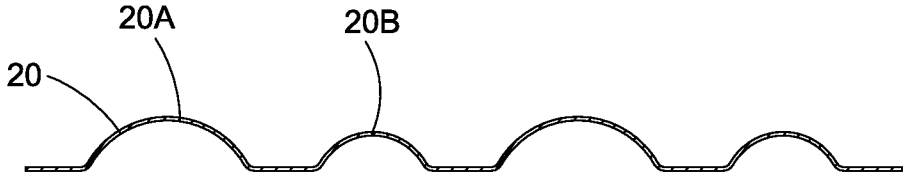

As shown in FIG. 4B, in the preferred embodiment of the present application, the buffer packages 20 of the buffer packaging layer have different sizes (diameters). Specifically, in the preferred embodiment of the present application, the buffer package 20 further includes a first buffer layer 20A and a second buffer layer 20B, wherein the bottom diameter of the first buffer layer 20A is greater than that of the second buffer layer 20B. Therefore, when the two layers of buffer packaging layers are stacked up and down, the first buffer layer 20A can be placed on top of the second buffer layer 20B, and the second buffer layer 20B is placed inside the first buffer layer 20A. By providing double buffer protection through the first buffer layer 20A and the second buffer layer 20B of the buffer package 20, the buffering and supporting effect can be improved.

Figure 4C:
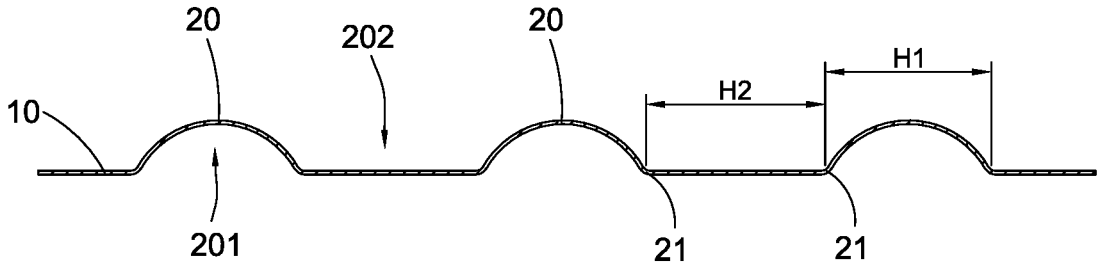

As shown in FIG. 4C, in the preferred embodiment of this application, different from the first preferred embodiment above, the outer diameter of the bottom 21 of the buffer packages 20 in the buffer package 20 is H1 and the distance between the bottom 21 of adjacent buffer packages 20 is H2, where H1 and H2 satisfy the following condition: $H1 \leq H2$. It can be understood that when two buffer pack layers are relatively arranged, a buffer package 20 of one buffer pack layer can be positioned in alignment within the gap space 201 of another buffer pack layer, so that the two buffer pack layers can be aligned with each other. It can be understood that two aligned buffer pack layers can provide buffering and support in two directions (from the front and back of the base layer 10).

Figure 4D:
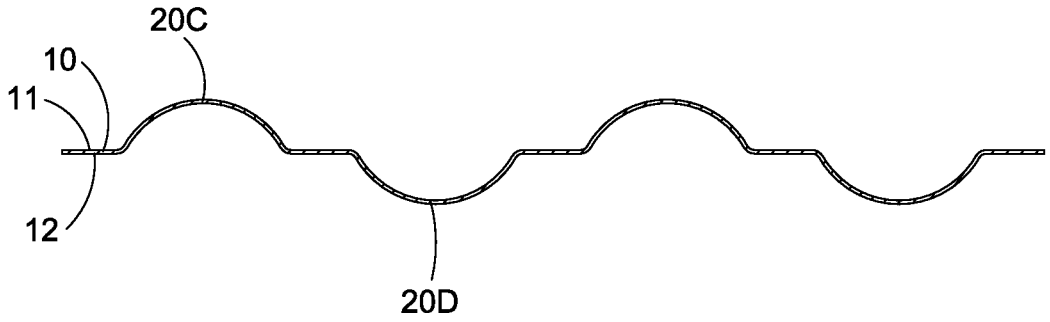

As shown in FIG. 4A to FIG. 4C, the buffer packages 20 is formed on one side of the base layer 10, i.e., the buffer packages 20 is formed on the front or back of the base layer 10. As shown in FIG. 4D, the buffer packages 20 is formed on both the front and back of the base layer 10. Accordingly, the buffer packages 20 further comprises a front buffer package 20C and a back buffer package 20D, wherein the front buffer package 20C is formed on the front 11 of the base layer 10, i.e., the front buffer package 20C protrudes and extends upward from the front of the base layer 10; and the back buffer package 20D is formed on the back 12 of the base layer 10, i.e., the back buffer package 20D protrudes and extends downward from the back of the base layer 10.

It can be understood that the front buffer package 20C located on the front of the base layer 10 can provide buffering and support functions from the base layer 10; and the back buffer package 20D located on the back of the base layer 10 can provide buffering and support functions from the base layer 10.

It should be noted that, in the preferred embodiment of the present application, the front buffer package 20C and the back buffer package 20D of the buffer packages 20 are spaced apart from each other, and the front buffer package 20C and the back buffer package 20D extend integrally from the base layer 10.

Figure 4E:
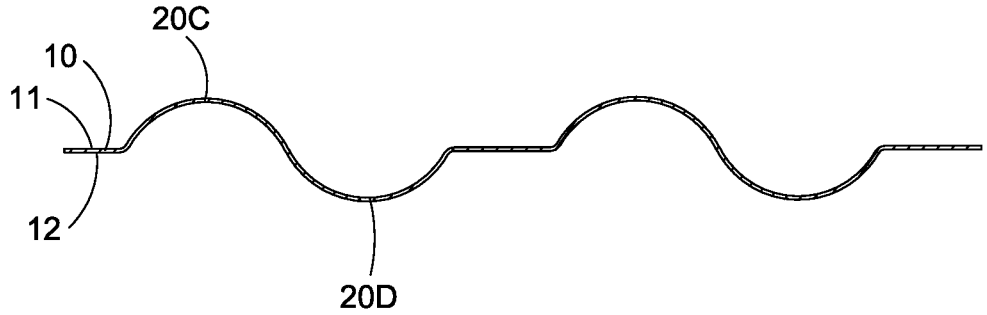
Figure 5:
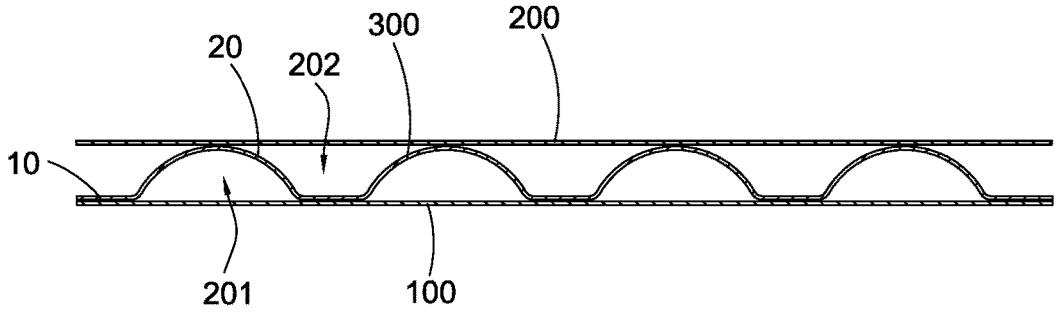
FIG. 5 is a schematic diagram of the structure of packaging paper according to the second embodiment of the present invention.

As shown in FIG. 4E, the difference from the buffer packaging layer of the above-mentioned preferred embodiment is that the front buffer package 20C of the buffer layer extends integrally from the back buffer package 20D of the buffer layer 20, that is, the front buffer package 20C and the back buffer package 20D are integrally structured.

As shown in FIGS. 5 to 8, a packaging paper according to another preferred embodiment of the present application is described below. The packaging paper includes an inner layer 100, an outer layer 200, and at least one packaging buffer layer 300 set between the inner layer 100 and the outer side 200. The structure of the packaging buffer layer 300 is the same as that in any of the preferred embodiments mentioned above and will not be repeated here.

The packaging buffer layer 300 is located between the inner layer 100 and the outer layer 200, wherein the packaging buffer layer 300 is adhered to the inner side of the inner layer 100 and the outer layer 200 by adhesive means. The top of the buffer package of the packaging buffer layer 300 is adhered to the inner side of the inner layer 100 or the inner side of the outer layer 200, and the spacing space 202 of the packaging buffer layer 300 is sealed by the inner layer 100 or the outer layer 200, thereby forming a sealed gas storage structure. Correspondingly, the base layer 10 of the packaging buffer layer 300 is adhered to the inner layer 100 or the outer layer 200 for sealing, thereby forming a sealed gas storage structure.

Figure 6:
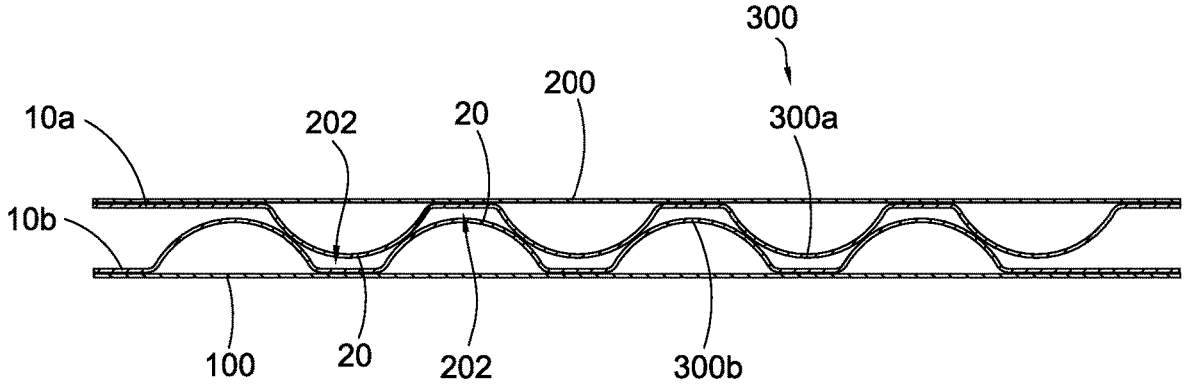
FIG. 6 is a schematic diagram of the structure of another optional embodiment of the packaging paper according to the second embodiment of the present invention.

It can be understood that when the packaging buffer layer 300 of the packaging paper is multi-layered, a plurality of buffer structure is formed by the packaging buffer layer 300. As shown in FIG. 6, in this preferred embodiment of the present application, the packaging buffer layer 300 of the packaging paper further comprises a first buffer layer 300*a* and a second buffer layer 300*b*. The first buffer layer 300*a* and the second buffer layer 300*b* have the same structure, and the first buffer layer 300*a* and the second buffer layer 300*b* are relatively positioned. The buffer packages 20 of the first buffer layer 300*a* corresponds to the gap space 202 of the second buffer layer 300*b*, and the buffer packages of the first buffer layer 300*a* is set inside the gap space 202 of the second buffer layer 300*b*. The buffer packages 20 of the second buffer layer 300*b* corresponds to the gap space 202 of the first buffer layer 300*a*, and the buffer packages 20 of the second buffer layer 300*b* is set inside the gap space 202 of the first buffer layer 300*a*.

The base layer 10*a* of the first buffer layer 300*a* and the base layer 10*b* of the second buffer layer 300*b* of the packaging buffer layer 300 are adhered between the inner layer 100 and the outer layer 200. It should be understood that in this preferred embodiment of the present application, the double-layer structure of the packaging buffer layer 300 provides a buffering effect from the inner layer 100 and the outer layer 200.

Figure 7:
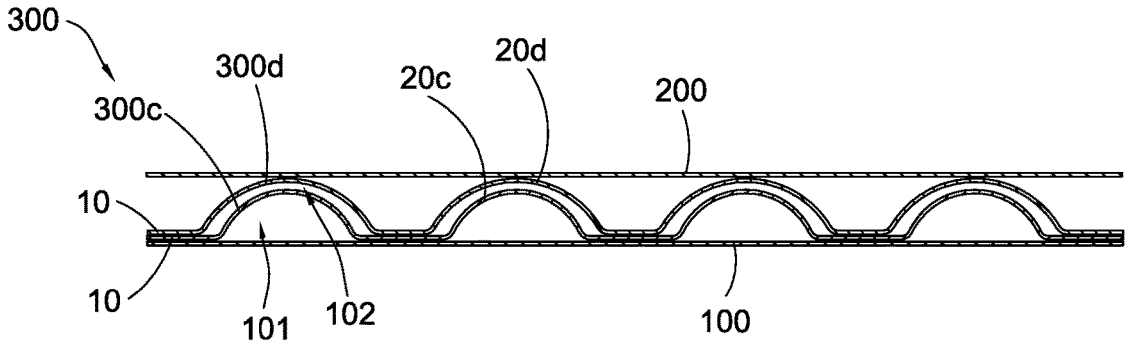
FIG. 7 is a schematic diagram of the structure of another optional embodiment of the packaging paper according to the second embodiment of the present invention.

As shown in FIG. 7, in the preferred embodiment of the present application, the packaging buffer layer 300 further comprises an inner buffer layer 300*c* and an outer buffer layer 300*d*. The size of the buffer package 20*c* in the inner buffer layer 300*c* is smaller than the size of the buffer package 20*d* in the outer buffer layer 300*d*. Therefore, when the inner buffer layer 300*c* and the outer buffer layer 300*d* are aligning, the buffer package 20*c* of the inner buffer layer 300*c* is nested inside the buffer package 20*d* of the outer buffer layer 300*d*.

In the preferred embodiment of the present application, the inner layer 100 is positioned on one side of the inner buffer layer 300*c* of the packaging buffer layer 300, while the outer layer 200 is positioned on one side of the outer buffer layer 300*d*, wherein the inner buffer layer 300*c* and the outer buffer layer 300*d* of the packaging buffer layer 300 are stacked on top of each other.

In the preferred embodiment of the present application, the inner buffer layer 300*c* and the outer buffer layer 300*d* of the packaging buffer layer 300 are adhesively bonded to form a double-layer buffer structure, wherein the inner layer 100 is adhesively bonded to the base layer 10 of the inner buffer layer 300*c*, and the outer side 200 is adhesively bonded to the top of the outer buffer layer 300*d*. Thus, the packaging buffer layer 300 forms a double air chamber structure, namely an inner air chamber 101 formed by the inner buffer layer 300*c* and the inner layer 100, and an outer air chamber 102 formed by the inner buffer layer 300*c* and the outer buffer layer 300*d*, forming a dual air chamber buffer structure of the packaging buffer layer 300.

Understandably, in this preferred embodiment of the present application, the inner air chamber 101 of the packaging buffer layer 300 is a sealed air chamber structure formed by the inner layer 100 and the inner buffer layer 300*c*. The outer air chamber 102 is a sealed structure formed by the inner buffer layer 300*c* and the outer buffer layer 300*d*.

It can be understood that when the side of the packaging paper is subjected to force, the inner buffer layer 300*c*, outer buffer layer 300*d* and the multilayer support structure formed by the inner air chamber 101 and outer air chamber 102 formed in the packaging piercing layer 300 of the packaging buffer layer 300 provide a dual support and cushioning structure for the packaging paper.

Preferably, in this preferred embodiment of the present application, the packaging paper is a paper structure, wherein the inner layer 100 is non-bubble paper such as kraft paper, which helps reduce friction and keep the internal structure flat. The outer layer 200 is a paper structure, such as kraft paper.

Figure 8:
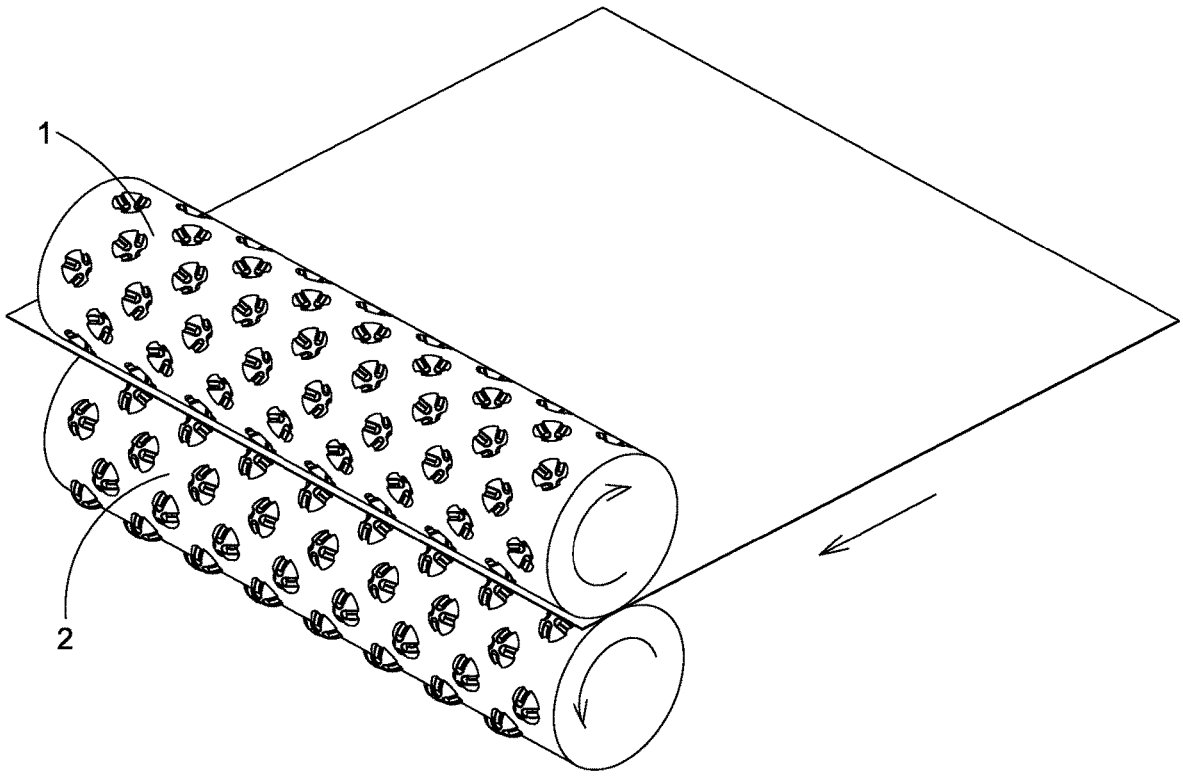
FIG. 8 is a schematic diagram of the manufacturing method of the buffer packaging layer according to the preferred embodiment of the present invention.

Referring to FIG. 8 of the attached drawings in this application specification, and according to another aspect of this application, a method for producing a packaging buffer layer is provided. As the packaging buffer layer is a paper-based structure, the buffer structure is formed on the surface of the paper by roll pressing or extrusion during the production process.

Rolling wheel 1 and rolling wheel 2 are the molds required to process the packaging buffer layer. Rolling wheel 1 and rolling wheel 2 form the buffer pack on the paper to be processed by rolling. Rolling wheel 1 and/or rolling wheel 2 have A plurality of raised structures, wherein the raised structures correspond to the buffer pack structure of the packaging buffer layer.

It should be noted that the processing method of the packaging buffer layer mentioned here is only exemplary and not limiting.

The following specific embodiments are provided to illustrate the implementation of the present invention, and those skilled in the art can fully understand other advantages and technical effects of the present invention based on the content disclosed in this specification. The present invention can also be implemented or applied in different specific ways, and various details in this specification can be modified or changed based on different viewpoints without departing from the overall design concept of the invention. It should be noted that, in cases that are not conflicting, the features in the following embodiments can be combined with each other. The following exemplary embodiments of the present invention can be implemented in various forms and should not be interpreted as being limited to the specific embodiments described here. It should be understood that these embodiments are provided to thoroughly and completely disclose the present invention, and to fully convey the technical solutions of these exemplary specific embodiments to those skilled in the art.

It should be understood that when a component is referred to as being "connected" or "joined" to another component, the component can be directly connected or joined to the other component, or may exist an intermediate component. The difference is that when a component is referred to as being "directly connected" or "directly joined" to another component, there is no intermediate component. In all of the accompanying drawings, the same reference numerals always denote the same components.

Third Embodiment

Figure 9:
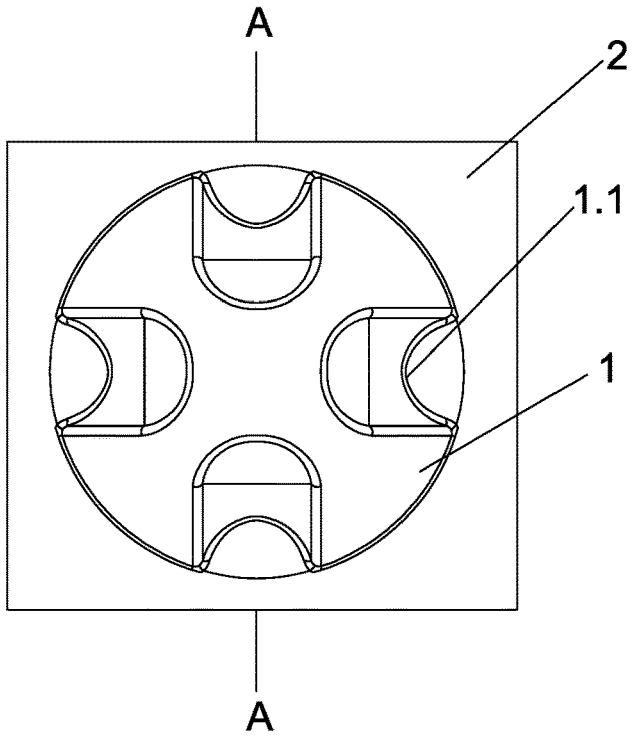
FIG. 9 is a schematic diagram of the structure of the third embodiment of the present invention.
Figure 10:
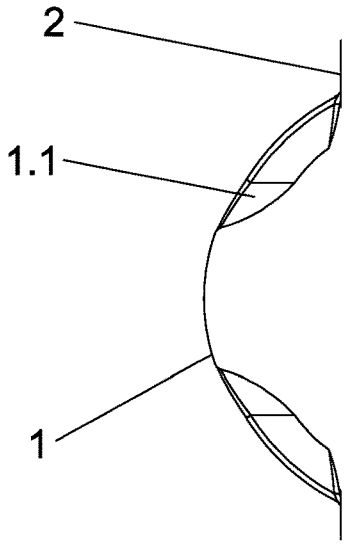
FIG. 10 is a schematic diagram showing the structure of the second embodiment of the present invention.

As shown in FIG. 9 combined with FIG. 10, the present invention provides a deformable buffer monomer structure, comprising: a deformation part 1 and a connecting part 2.

Deformation part 1, which is formed as a spherical cap. A plurality of reinforcement parts 1.1 are formed on the outer curved surface of the spherical cap, which can undergo deformation when subjected to force.

Connection part 2, which is formed around the deformation part 1, extends outwardly from the deformation part.

Wherein, the deformation part 1 and the connecting part 2 are made of degradable and environmentally friendly materials.

Optionally, the reinforcement part 1.1 in this embodiment comprises four uniformly formed concave parts on the spherical cap. These concave parts will cause creases on the spherical cap wall, and the strength of the wall at the creases will necessarily be greater than at other locations on the spherical cap.

Similarly, the reinforcement part 1.1 can be selected as reinforcing ribs formed on the ball head, for example, thickening the wall thickness of the ball head at the specified location (reinforcement rib location).

Fourth Embodiment

Figure 11:
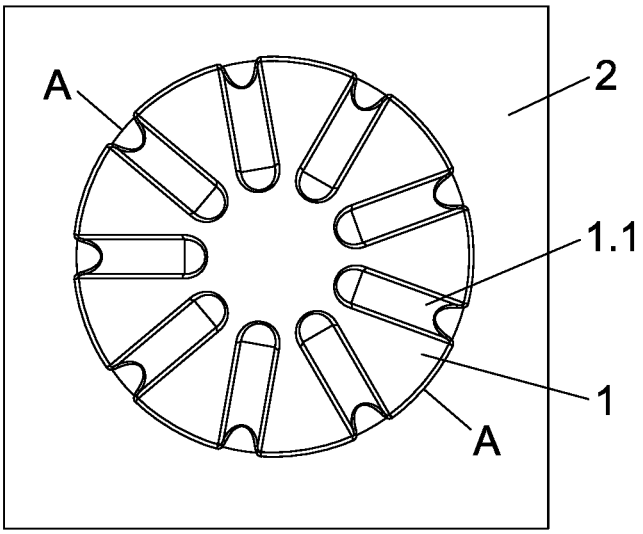
FIG. 11 is a schematic diagram of the structure of the fourth embodiment of the present invention.
Figure 12:
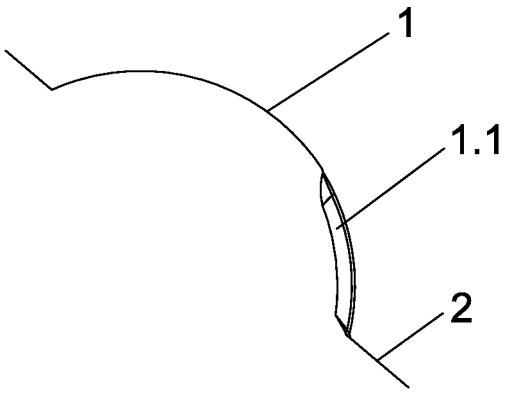
FIG. 12 is the structural schematic diagram two of the fourth embodiment of the present invention.

As shown in FIG. 11 in conjunction with FIG. 12, the present invention provides a deformable buffer monomer structure, comprising: a deformation part 1 and a connecting part 2.

Deformation part 1, which is formed as a spherical cap, wherein A plurality of reinforcement parts 1.1 are formed on the outer curved surface of the spherical cap, which can withstand the force and undergo deformation.

Connection part 2, which is formed around the deformation part 1, with the connection part extending outward from the deformation part.

Wherein, the deformation part 1 and connecting part 2 are made of degradable environmental-friendly materials.

Optional, in this embodiment, the reinforcement part 1.1 is made up of 9 uniformly formed depressions pressed down on the spherical cap. These depressions will cause the wall of the spherical cap to form creases, and the strength of the spherical cap wall at the creases will inevitably be greater than the strength at other positions of the spherical cap.

Correspondingly, the reinforcement part 1.1 can be selected to be formed on the spherical cap as reinforcement ribs, for example, thickening the wall thickness of the spherical cap at a specified location (reinforcement rib location).

Fifth Embodiment

The fifth embodiment of the present invention is a further improvement based on the third and fourth embodiments described above. The same parts will not be described again. It also includes:

a bonding section is formed on the bottom surface of the connecting section, and it is used to bond and fix the deformable buffer monomer structure to the external structure.

Optional, wherein the adhesive portion covers the entire bottom surface of the connecting portion.

Alternatively, the adhesive portion is formed as an adhesive dot and is set on the bottom surface of the connecting portion. The adhesive portion can be coated with pressure-sensitive adhesive.

Sixth Embodiment

Figure 13:
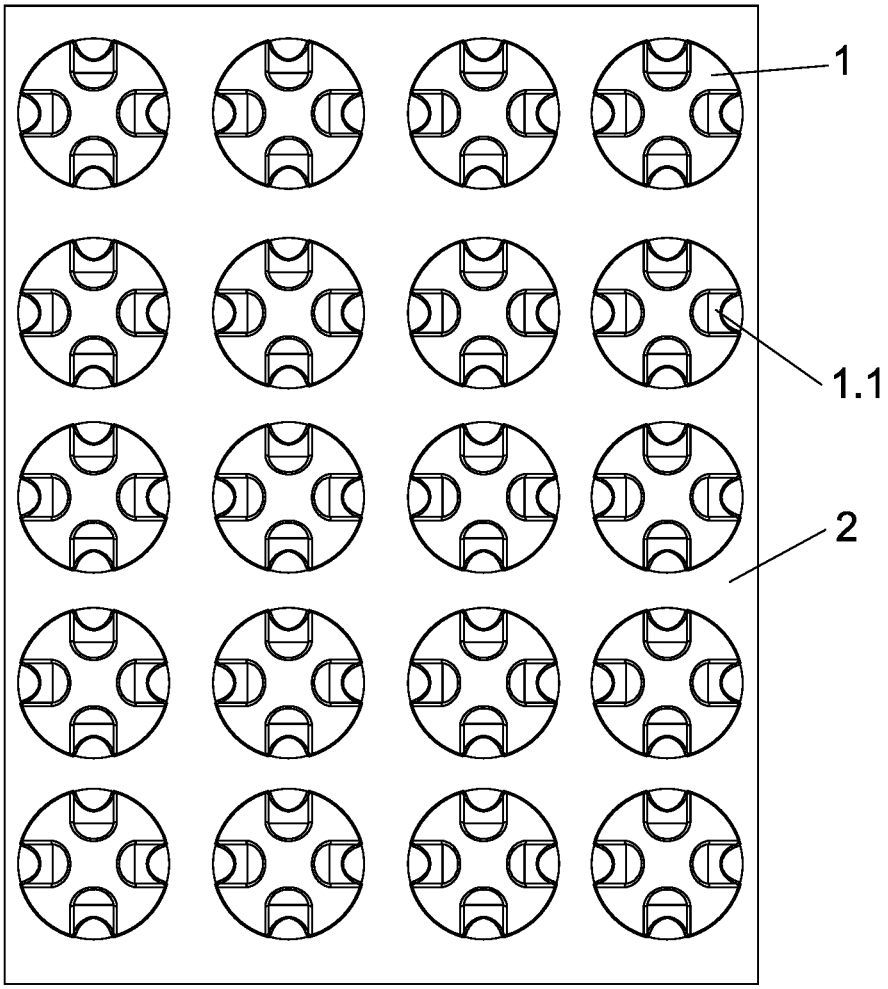
FIG. 13 is a schematic diagram of the structure of the sixth embodiment of the present invention.

Referring to FIG. 13, the present invention provides a packaging paper comprising a deformable cushioning unit structure as described in any one of the third to fifth embodiments, which is formed by connecting A plurality of connecting portions of said deformable cushioning unit structure to each other.

Optionally, to further improve the sixth embodiment mentioned above, the size, spacing, and/or color of each deformable buffer unit structure may be different.

Seventh Embodiment

The present invention provides a packaging paper bag with a deformable buffering unit structure as described in any of the third to fifth embodiments, wherein the bag body is any existing packaging paper bag, and its inner wall is bonded with at least one of the deformable buffering unit structures.

Unless otherwise defined, all terms used here (including technical and scientific terms) have the same meaning as commonly understood by those skilled in the art to which the invention pertains. It will also be understood that unless explicitly defined here, terms such as those defined in a general dictionary should be interpreted as having the same meaning as they do in the context of the relevant field, and not interpreted with ideal or overly formal definitions.

The above has provided detailed explanations of the present invention through specific embodiments and examples, but these are not limitations to the present invention. Many modifications and improvements can still be made by those skilled in the art without departing from the principles of the present invention, and these should also be considered within the scope of protection of the present invention.

Those skilled in the art should understand that the embodiments of the present invention shown in the above description and accompanying drawings are provided as an example and not intended to limit the present invention. The objects of the present invention have been fully and effectively achieved. The functional and structural principles of the present invention have been demonstrated and explained in the embodiments, and without departing from the disclosed principles, various modifications or alterations can be made to the embodiments of the present invention.

What is claimed is:

1. A packaging paper, comprising:

an inner layer and an outer layer; and at least one paper packaging buffer layer, wherein the at least one paper packaging buffer layer is set between the inner layer and the outer layer, the at least one paper packaging buffer layer comprise a base layer and a plurality of buffer packages and a plurality of air chambers formed in the plurality of buffer packages, wherein the plurality of buffer packages are formed on the base layer, the plurality of air chambers are formed on an inner side of the plurality of buffer packages, each buffer package of the plurality of buffer packages includes a bottom portion and a top portion integrally extending outward from the bottom portion, the bottom portion of each buffer package of the plurality of buffer packages integrally extending upward from the base layer to the top portion of each respective buffer package of the plurality of buffer packages, wherein each buffer package of the plurality of buffer packages is further provided with at least one rib groove, and the at least one rib groove is formed on a surface of each buffer package of the plurality of buffer packages;

wherein the at least one paper packaging buffer layer further comprises an inner buffer layer and an outer buffer layer, wherein a size of each buffer package of the plurality of buffer packages of the inner buffer layer is smaller than a size of each buffer package of the plurality of buffer packages of the outer buffer layer, each buffer package of the plurality of buffer packages of the inner buffer layer is sleeved inside the outer buffer layer, and the inner buffer layer and outer buffer layer are integrally formed with the base layer to create a radial gap for absorbing impact energy through controlled deformation.

2. The packaging paper, as claimed in claim 1, wherein the inner buffer layer and the inner layer form a sealed inner air chamber, the inner buffer layer and the outer buffer layer form a sealed outer air chamber, the inner and outer air chambers form a dual air chamber buffer structure.

* * * * *